US006945834B2

(12) United States Patent
Häger et al.

(10) Patent No.: US 6,945,834 B2
(45) Date of Patent: Sep. 20, 2005

(54) STEERING ARRANGEMENT FOR SHIPS WITH WATER JET UNIT

(75) Inventors: Christer Häger, Kristinehamn (SE); Sven-Gunnar Karlsson, Kristinehamn (SE)

(73) Assignee: Rolls-Royce Aktiebolag, Kristinehamn (SE)

( * ) Notice: Subject to any disclaimer, the term of this patent is extended or adjusted under 35 U.S.C. 154(b) by 41 days.

(21) Appl. No.: 10/416,226

(22) PCT Filed: Nov. 14, 2001

(86) PCT No.: PCT/SE01/02516

§ 371 (c)(1),
(2), (4) Date: May 8, 2003

(87) PCT Pub. No.: WO02/40344

PCT Pub. Date: May 23, 2002

(65) Prior Publication Data

US 2004/0033736 A1 Feb. 19, 2004

(30) Foreign Application Priority Data

Nov. 14, 2000 (SE) ..... 0004174

(51) Int. Cl.[7] ..... B63H 11/11; B63H 11/113
(52) U.S. Cl. ..... 440/41; 440/42
(58) Field of Search ..... 440/38, 40, 41, 440/42, 43, 2

(56) References Cited

U.S. PATENT DOCUMENTS 3,422,788 A 1/1969 Horan ..... 115/12
4,026,235 A * 5/1977 Woodfill ..... 440/41
4,051,801 A * 10/1977 Woodfill et al. ..... 440/1
4,474,561 A 10/1984 Haglund ..... 440/41
4,538,997 A * 9/1985 Haglund ..... 440/41
5,246,392 A * 9/1993 Johnston ..... 440/42
5,713,770 A * 2/1998 Ambli ..... 440/41

FOREIGN PATENT DOCUMENTS

DE 32 47 628 A1 * 7/1984
SE 449 333 4/1987

* cited by examiner

*Primary Examiner*—Sherman Basinger
(74) *Attorney, Agent, or Firm*—Michael Bednarek; Pillsbury Winthrop Shaw Pittman LLP

(57) ABSTRACT

The present invention relates to a steering arrangement for ships with a water jet unit, comprising a steering device that is pivotable about an essentially vertical shaft having a first center line, at least one hydraulic cylinder articulately connected at a first end of the hydraulic cylinder to the attachment flange of the water jet unit, a turning device connected to the shaft for attachment to a second end of the hydraulic cylinder at a distance from the shaft, a reversing device for pivoting the steering device, the reversing device being arranged about an essentially horizontal shaft, an additional hydraulic cylinder arranged to act on the reversing device, the additional hydraulic cylinder following the movement of the steering device, characterized in that all the hydraulic cylinders are arranged within a sheltered space located above the extension of the vertical shaft.

19 Claims, 3 Drawing Sheets

STEERING ARRANGEMENT FOR SHIPS WITH WATER JET UNIT

TECHNICAL FIELD

The present invention relates to a steering arrangement for ships with water jet unit, comprising a steering device that is pivotable about an essentially vertical shaft having a first centre line, at least one hydraulic cylinder articulately connected at a first end of the hydraulic cylinder to the attachment flange of the water jet unit, a turning device connected to said shaft for attachment to a second end of said hydraulic cylinder at a distance from said shaft for pivoting the steering device, a reversing device being arranged about an essentially horizontal shaft, an additional hydraulic cylinder arranged to act on the reversing device, the additional hydraulic cylinder following the movement of the steering device.

STATE OF THE ART AND PROBLEM

Large water jet units have lately become more and more popular for driving bigger ships. Steering a ship with water jet is achieved according to a well-known principle by means of a box-shaped, pivoting steering device controlled by powerful hydraulic cylinder units, and a reversing device controlled by its own hydraulic cylinder and suspended in the steering device. However, the hydraulics is placed in the water, that is, outside the body. This involves a potential environmental hazard since the conduits with hydraulic oil for the cylinders might break and cause leakage of hydraulic oil into the water. It is a wish from some clients that this potential safety hazard is eliminated.

It is known to solve said problem by moving the hydraulic pistons inside the craft's transom frame and instead control the steering device and the reversing device suspended in the steering device by means of linked mechanisms, which are described in "Speed at Sea" in the June-number 2000. Because of the location of the reversing device these linked mechanisms are very long and cumbrous. It also causes unwanted extra penetration of the transom, which has to be sealed. Since movements are desired in both the vertical and the horizontal direction this solution also leads to several hinges, which may cause problems concerning both structural strength and accuracy of steering.

An alternative solution to this problem is disclosed in U.S. Pat. No. 3,422,788, where it is chosen not to make the whole steering device pivoted but only a rudder-like element placed inside a kind of steering device, which is fixed. The reversing device is, in its part, suspended in the fixed steering device. Thus, the problem of the reversing device's influence is solved since the hydraulic piston that acts on the reversing device does not have to participate in any lateral movements. However, this solution involves many other considerable disadvantages, above all, an essentially deteriorated efficiency. Hence, it is not an acceptable solution.

Also through U.S. Pat. No. 3,807,346 a water jet is previously known where the steering-and reversing devices are controlled by a hydraulic placed in a sheltered position. However, this solution shows that the reversing device moves laterally, not vertically, which is the conventional and desirable solution. Hence, this alternative construction is not desirable.

BRIEF DESCRIPTION OF THE INVENTION

It is an object of the present invention to find an optimal solution to the above-described complex of problems. This is achieved by means of a steering arrangement for ships with water jet unit, comprising a steering device that is pivotable about an essentially vertical shaft having a first centre line, at least one hydraulic cylinder articulately connected at a first end of the hydraulic cylinder to the attachment flange of the water jet unit, a turning device connected to said shaft for attachment to a second end of said hydraulic cylinder at a distance from said shaft for pivoting the steering device, a reversing device being arranged around an essentially horizontal shaft, an additional hydraulic cylinder arranged to act on the reversing device, the additional hydraulic cylinder following the movement of the steering device, wherein all hydraulic cylinders are arranged within a sheltered space located above the extension of said vertical shaft, and said sheltered space at the rear end is arranged with a slit shaped opening.

Due to this solution it is possible to achieve a sheltered inclusion of hydraulic conduits and connections, and also a sheltered location of possible positional measuring equipment for automatic control of the steering, simultaneously avoiding unwanted linkage mechanisms.

According to further aspects of the invention:

- said hydraulic cylinder to act on the reversing device is pivotally suspended about an essentially horizontal shaft having a second centre line,
- said centre line for said hydraulic cylinder comes close to, preferably cuts, said first centre line,
- said second centre line for the suspension of the hydraulic cylinder comes close to, preferably cuts, said first centre line,
- said space is shaped as a module,
- also said positional measuring equipment for measuring the position of the steering device and/or the reversing device is arranged within said space,
- said bottom-part of said space is at least partially arranged above and in contact with the outlet-part of the water jet unit,
- two cylinders are used for turning said steering device, which are articulately connected to the turning device with one of their ends at both sides of said shaft,
- said sheltered space at the rear end is arranged with a sealed, preferably slit-shaped opening for the piston rod for the reversing device, that said piston rod in an sealed manner may move forwards and backwards and possibly also vertically,
- said upper end of said shaft is placed within said space.

DESCRIPTION OF DRAWINGS

The invention will be explained more in detail with reference to the attached drawings, wherein.

DETAILED DESCRIPTION OF THE INVENTION

Figure 1:
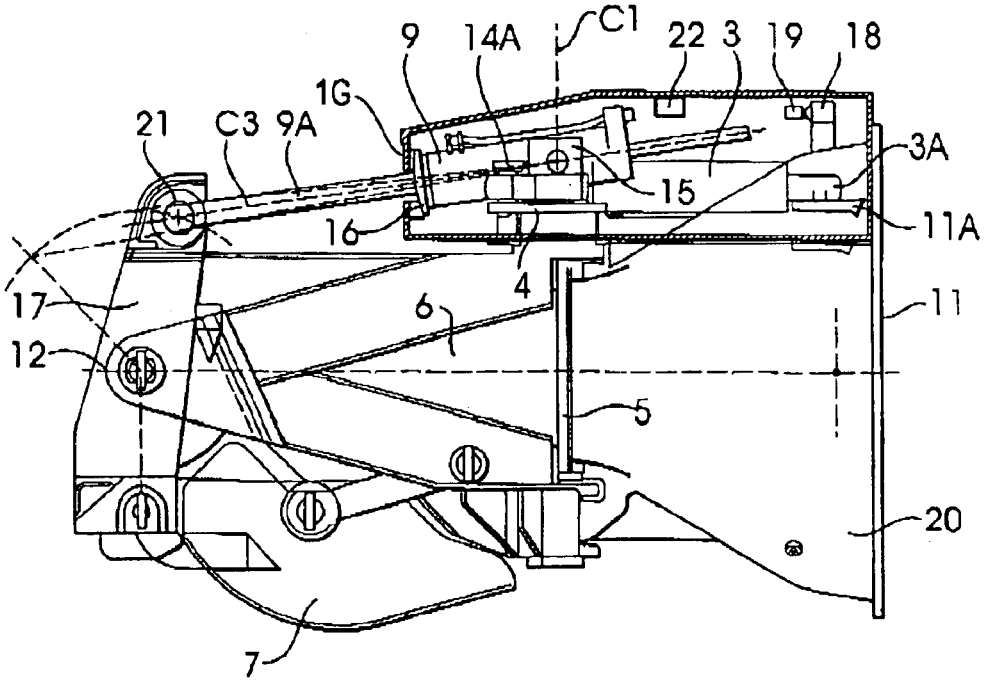
FIG. 1 shows a preferred steering arrangement according to the invention as a side view, partly as a cross-section.
Figure 2:
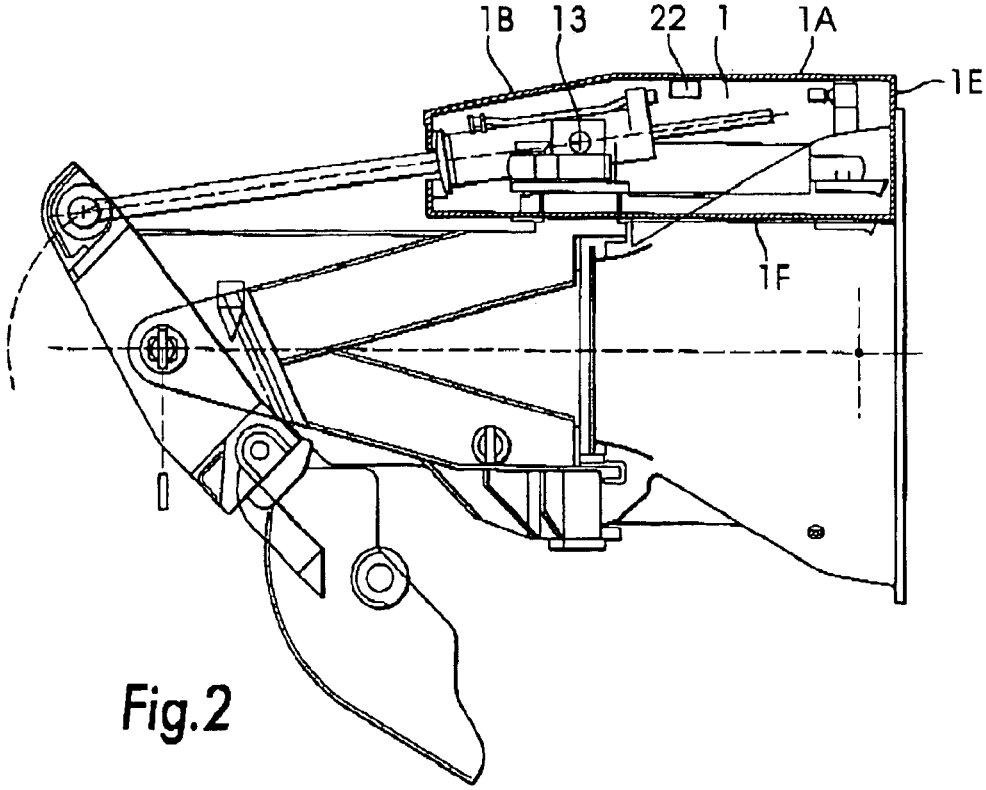
FIG. 2 shows the same view as FIG. 1 but with the reversing device in another position.

In FIGS. 1 and 2 there is shown in a side view two different positions for an arrangement according to the invention. The basic design of the steering arrangement is made in a conventional way. Thus, a steering arrangement known in itself is disclosed that comprises a steering device 6 that is pivotable about a vertical shaft 5, which is fixed in the water jet's outlet-part 20 which in its turn is attached to the ship's transom. Furthermore, this basic construction consists of a beam arrangement fixed at each side of the steering device and in which there is arranged a hinge 12 for suspension of a lever arm 17 of a reversing device 7. In FIG. 1 the reversing device is shown in its inactivated mode, that is, a position for full speed ahead.

In FIG. 2 the reversing device is shown in an activated mode, where the jet stream thus is diverted for the achievement of a reversing force.

The novel feature of this design is the arrangement of the hydraulic cylinders 2, 3, 9 that act on steering device 6, and reversing device 7 respectively. The cylinders 2, 3, 9 are arranged within a closed space 1 above the basic construction. The space is box-shaped and delimited by a number of plates 1A–1G. The front plate 1E is meant to be fixed to the jet unit's attachment flange 11, while the rear plate 1G is arranged at a sufficient distance from the front plate 1E to be able to hold the whole cylinder 9 (for the reversing device 7) which is placed furthest back of the cylinders 2, 3, 9 which are about the same size. The lower plate 1F is partly arranged essentially horizontally and holds the upper end of the vertical shaft 5 for the steering device 6. The upper plates 1A, 1B are arranged so that sufficient space is obtained for hydraulic cylinders with associated surrounding equipment, eg., hydraulic conduits and positional measuring equipment 22. A yoke-shaped swinging arm 4 is fixed at and pivotable together with the vertical shaft 5. Two shaft pivots 14A, 14B (see FIG. 3) are arranged on top of this swinging arm 4, and the front end 3A, 2A of the hydraulic cylinders 2, 3 for turning the steering device 6 are articulately arranged at said shaft pivots. Moreover, there is at said swinging arm 4 arranged two attachment handles 15 for pivotable suspension of the hydraulic cylinder 9 by a shaft 13 that is fixed at said hydraulic cylinder 9. Thus, the hydraulic cylinder 9 for the reversing device 7 is connected to the shaft 5 so that it swings along with it in its movements. The centre line C2 of the shaft 13 for suspension of the cylinder 9 is arranged such that it crosses the centre line C1 of the vertical shaft 5. Moreover, the centre line C3 for the hydraulic cylinder 9, (see FIG. 4) is arranged to cross the centre line C1 of the vertical shaft 5. This suspension means that the relative position of the reversing device 7 related to its hydraulic cylinder 9, is not influenced by the steering device's 6 relative position. Thus the reversing device (7) does not change its position relative to the steering device even if the steering device is turned to different positions, which would be the case if the suspension of the cylinder 9 were not according to this invention.

Furthermore, it is shown that the piston rod 9A for acting on the reversing device 7 protrudes from the box-shaped space 1 through a sealed slit 16 which is arranged in the back end 1G of the box-construction. Preferably the slit 16 is sealed to hinder water from flowing into the sheltered space 1 and also to hinder possibly leaking oil from flowing out from it. The slit 16 enables the hydraulic cylinder 9 to perform a pivoting movement about the shaft 13, which is necessary since the hinge 21 for the piston rod 9A at the linkage arm 17 is moving along a circular arc, 21A meaning that the hydraulic cylinder 9 must be able to pivot upwards and downwards respectively, when the piston rod 9A is moving. The respective front end 3A and 2A of the turning hydraulic cylinders 2, 3 are articulately connected about a shaft pivot, that is arranged at the means of attachment element 11A and 1B respectively, which in their turn are firmly attached to the jet unit's attachment flange 11. Above and in-between said means of attachment elements 11A and 11B respectively, but within said space 1, a distribution chamber 18 for hydraulic oil is arranged, from which the hydraulic conduits 19 for supply and removal respectively, of oil for the hydraulic cylinders emanates. Due to this arrangement, both distribution chamber 18 and hydraulic conduits 19 will be placed in a sheltered position within said space 1.

Figure 3:
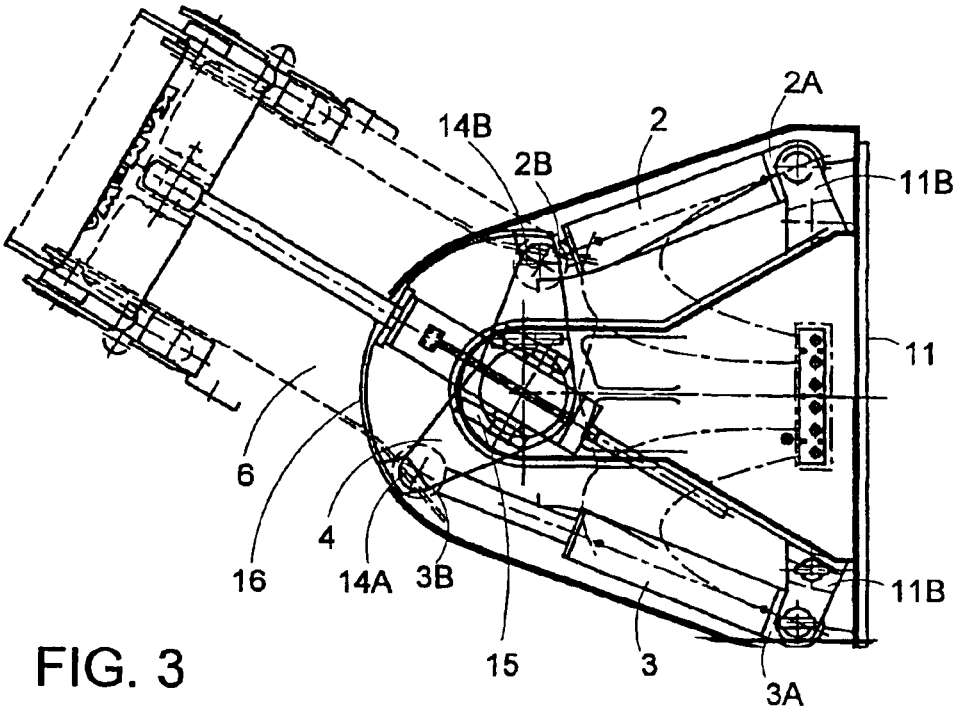
FIG. 3 shows the steering arrangement according to FIG. 1 seen from above, partly as a cross-section.
Figure 4:
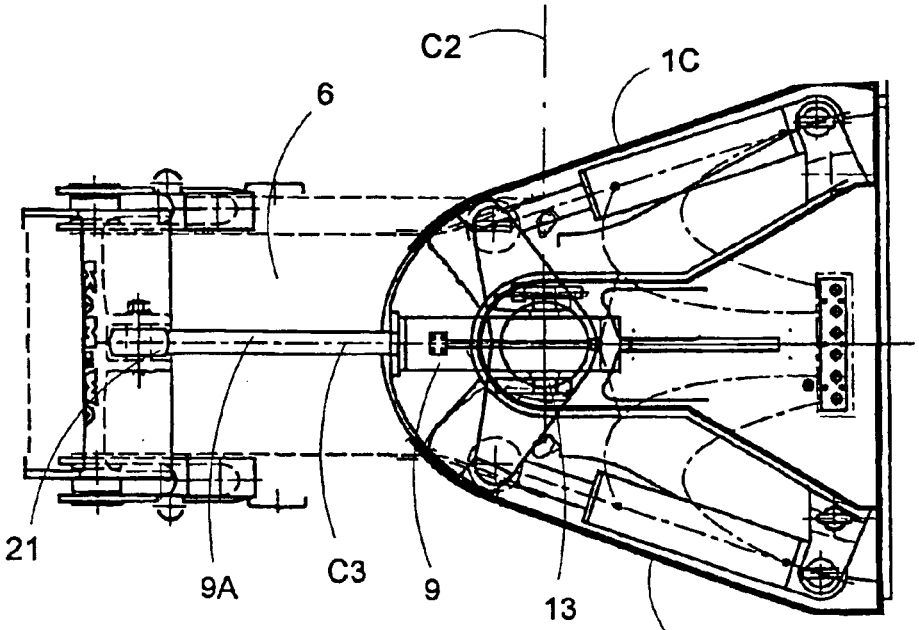
FIG. 4 shows the same view as FIG. 3 but with the steering device in another position.

FIGS. 3 and 4 show a steering arrangement according to the invention seen from above. In FIG. 3 the steering arrangement is shown in a swung out position, the steering device 6 being positioned obliquely related to the body's extension to be able to perform a yaw.

In FIG. 4 the steering device 6 is shown in a folded in position, i.e. for driving straight ahead when the reversing device 7 is inactivated. The position in FIG. 4 is achieved by means of the hydraulic cylinders 2, 3 being positioned with each end 2B, 3B of the piston rods, in a common plane which is parallel with the jet unit's attachment flange 11. From this position, by pushing out the piston rod of the lower (in the figure) hydraulic cylinder 3 and at the same time pressing the piston rod of the upper (in the figure) hydraulic cylinder 2, the swinging arm 4 is swung about the vertical shaft 5, so that the steering device 6 is angled relative to the jet unit's attachment flange 11 which leads to a yaw.

Owing to the invention it is gained a sheltered location of the hydraulics without having to use long and cumbrous linkage mechanisms. Also, the module principle, according to the invention entails, that existing arrangements can be modified in a simple way, so that sheltered location of hydraulics may be installed afterwards.

Figure 5:
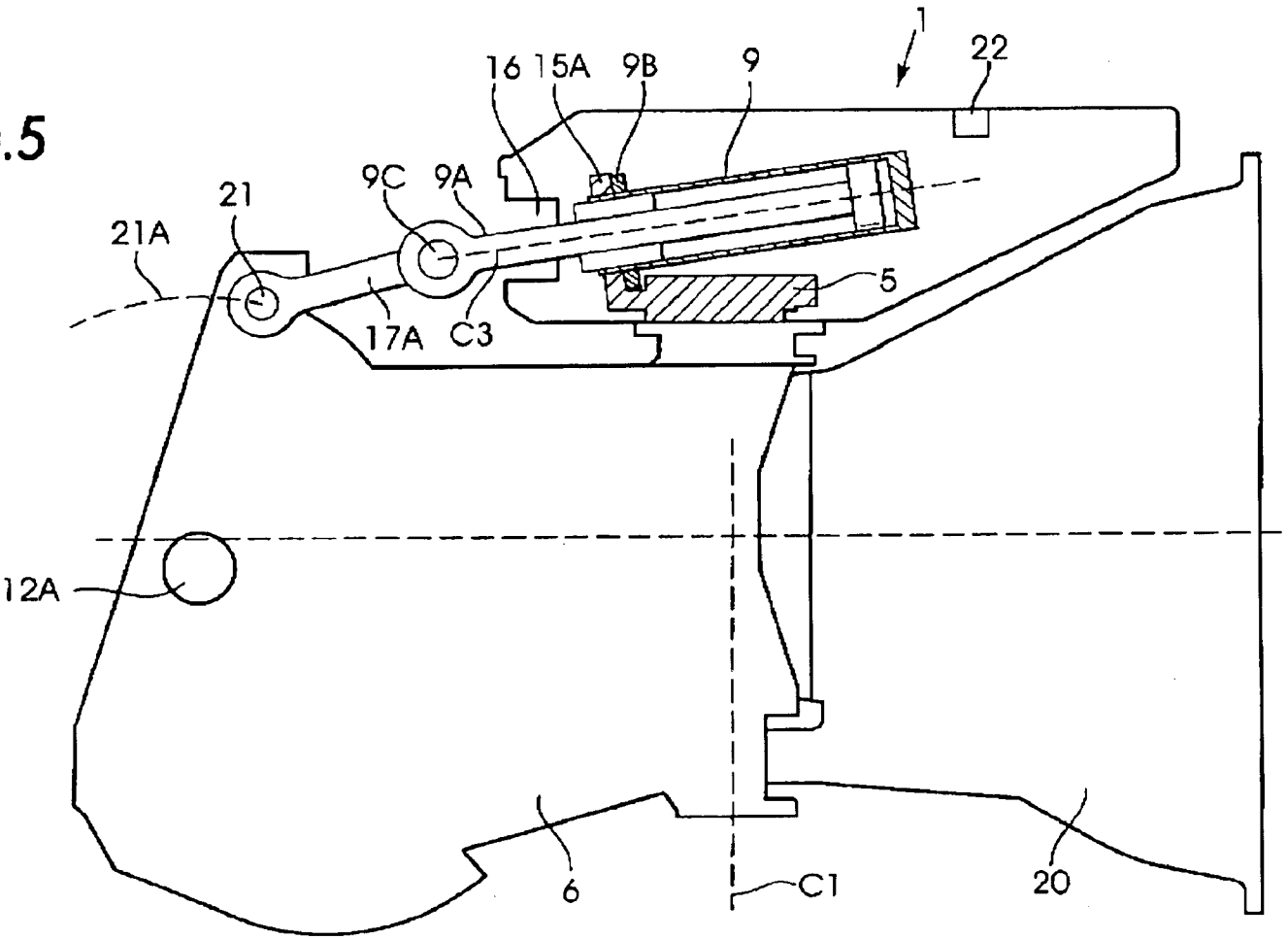
FIG. 5 shows a side view of a modified arrangement to according to the invention.

In FIG. 5, there is schematically shown a modification according to the invention. There is shown in a side view an outlet part 20, and steering device 6 with substantially the same design as described above. In other aspects the figure shows merely those elements that have been changed in relation to the above described preferred embodiment. An important difference is that the hydraulic cylinder 9 is fixedly attached to the attachment device 15A, (which preferably is in the form of a flange) at the top of the vertical shaft 5. The hydraulic cylinder 9 is arranged with a corresponding flange 9B, in order to be able to securely attach the hydraulic cylinder 9 to the attachment device 15A. Accordingly the piston rod 9A may merely be moved within one and the same horizontal plane, corresponding with the extension of the centerline C3 of the piston rod 9A. In order to compensate for the movement along a curve 21A of the hinge 21 for the linkage arm 17 (not shown) there is arranged an intermediate link 17A. This link 17A is pivotally attached to both the arm-hinge 21 at one end and to the piston hinge 9C at the other end. As described above the hydraulic cylinder (preferably also the other cylinders, which are not shown) is sheltered within a substantially closed space 1, having a horizontally extending slit 16 at one end for the piston rod 9A, such that the rod 9A may freely move in/out and sideways. Also in this embodiment the slit 16 preferably is sealed. In this connection it is advantageous to not having any pivoting movement of the hydraulic piston rod 9A in the vertical plan, i.e. the piston rod 9 will move within the same horizontal plan in relation to the slit 16 independent of the reversing device 7.

The invention is not limited to what has been described above but may be varied within the scope of the claims.

Thus, it is realized that it is not necessary with two hydraulic cylinders to act on the swinging arm but that in certain cases it is quite adequate with only one hydraulic cylinder. However, two symmetrically placed hydraulic cylinders for the turning is preferable, not at least for reliability-/safety reasons. Furthermore, it is realized that the principle also may be used, by means of linkage mechanisms, to connect in parallel several adjacently arranged steering arrangements.

The expression "connected to the attachment flange 11 of the water jet unit" may not be narrowly interpreted, but it is realized that "the connection" may be (and in many cases are) indirect, i.e. the connection may be formed through one or several intermediate elements. However, it is important the this "connection" is designed so that it may transmit the forces needed, which in the normal case i.a means that it is essentially rigid. It is also realized that "the connection" may be made at the transom stern instead of the jet unit. The main thing is that "the connection" is made to one of the ships solids. It should be understood that the closed space 1 not in all cases need to be sealed, by means of a sealing arrangement in the slit 16. Moreover it should be understood that if a seal is used it will not need to totally seal-off the closed space 1 in all kind of installations. In some installations it may be sufficient to, hinder a substantial flow of water in and out of the close space 1. Further it should be understood that the expression slit shaped opening (16) shall be construed in a broad manner, including alternatives where the opening is half-closed/open by the use of overlapping, flexible or movable, seal elements that allow the piston to be moved there between.

What is claimed is:

1. A steering arrangement for vessels having a water jet unit, the steering arrangement comprising;

a) a steering device (6) that is pivotable about an essentially vertical shaft (5) having a first center line (C1), b) at least one hydraulic cylinder (2; 3) articulately connected at a first end (2A, 3A) of the hydraulic cylinder to an attachment flange of the water jet unit, c) a turning device (4) connected to said shaft (5) for attachment to a second end (2B; 3B) of said hydraulic cylinder at a distance from said shaft (5) for pivoting the steering device (6), d) a reversing device (7) being arranged about an essentially horizontal shaft (12), e) an additional hydraulic cylinder (9) arranged to act on the reversing device (7), the additional hydraulic cylinder (9) following the movement of the steering device (6)

characterized in that the at least one hydraulic cylinder and the additional hydraulic cylinder (2, 3, 9) are located inside a sheltered space (1) located above an extension of the vertical shaft (5), that said sheltered space (1) at the rear end (1G) is arranged with a slit shaped opening (16), and that positional measuring equipment for measuring the position of the steering device (6) and/or the reversing device (7) is arranged within said sheltered space.

2. A steering arrangement according to claim 1 characterized in that said additional hydraulic cylinder (9) arranged to act on the reversing device (7) is pivotally suspended about an essentially horizontal shaft (13) having a second center line (C2).

3. Steering arrangement according to claim 2, characterized in that a center line (C3) of said additional hydraulic cylinder (9) comes close to-said first center line (C1).

4. Steering arrangement according to claim 2, characterized in that said second center line (C2) of said additional hydraulic cylinders (9) comes close to said first center line (C1).

5. Steering arrangement according to claim 1, characterized in that said sheltered space (1) is shaped as a module.

6. Steering arrangement according to claim 1, characterized in that a bottom part (1F) of said sheltered space (1) at least for some part is arranged on top of and in contact with, an outlet part (20) for the water jet unit.

7. Steering arrangement according to claim 1, characterized in that two cylinders (2, 3) articulately connected with said turning device (4) and with their first ends (2A, 3A) on each side of said shaft (5), are used for turning of the steering device (6).

8. Steering arrangement according to claim 1, characterized in that said sheltered space (1) at the rear end (1G) is arranged with a sealed opening (16) for a piston rod (9A) for the reversing device (7), so that said piston rod in a sealed manner may move horizontally within the slit (16) and possibly also vertically.

9. Steering arrangement according to claim 1, characterized in that said upper end of said shaft (5) is placed within said space (1).

10. A steering arrangement for vessels having a water jet unit, comprising:

a steering device pivotable about a substantially vertical shaft having a first center line;

at least one hydraulic cylinder articulately connected at a first end of the hydraulic cylinder to an attachment flange of the water jet unit;

a turning device connected to the shaft for attachment to a second end of the hydraulic cylinder at a distance from the shaft for pivoting the steering device;

a reversing device arranged about a substantially horizontal shaft;

positional measuring equipment arranged within a sheltered space for measuring the position of the steering device and/or the reversing device; and an additional hydraulic cylinder arranged to act on the reversing device, the additional hydraulic cylinder following the movement of the steering device, the hydraulic cylinders located inside the sheltered space located above an extension of the vertical shaft, and the sheltered space at the rear end arranged with a slit shaped opening.

11. The steering arrangement of claim 10, wherein the additional hydraulic cylinder is pivotally suspended about a substantially horizontal shaft having a second center line.

12. The steering arrangement of claim 11, wherein a center line of the additional hydraulic cylinder is in close proximity to the first center line.

13. The steering arrangement of claim 11, wherein the second center line is in close proximity to the first center line.

14. The steering arrangement of claim 10, wherein the sheltered space is shaped as a module.

15. The steering arrangement of claim 10, wherein a bottom part of the sheltered space, at least for some part, is arranged on top of and in contact with an outlet part for the water jet unit.

16. The steering arrangement of claim 10, wherein the at least one hydraulic cylinder comprises two hydraulic cylinders and the two hydraulic cylinders are operable to turn the steering device.

17. The steering arrangement of claim 10, wherein the sheltered space comprises a sealed opening for a piston rod for the reversing device, and the piston rod, in a sealed manner, is movable horizontally within the slit.

18. The steering arrangement of claim 17, wherein the piston rod is also vertically movable.

19. The steering arrangement of claim 10, wherein the upper end of the shaft is located within the sheltered space.

* * * * *